US011684221B2

(12) United States Patent
Blair

(10) Patent No.: US 11,684,221 B2
(45) Date of Patent: Jun. 27, 2023

(54) CORRUGATED PACKAGES FOR PRE-SATURATED WIPES

(71) Applicant: Illinois Tool Works Inc., Glenview, IL (US)

(72) Inventor: Paul M. Blair, Jonesboro, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/407,916

(22) Filed: Aug. 20, 2021

(65) Prior Publication Data

US 2022/0061599 A1 Mar. 3, 2022

Related U.S. Application Data

(60) Provisional application No. 63/069,974, filed on Aug. 25, 2020.

(51) Int. Cl.

| | |
|---|---|
| ***A47K 10/32*** | (2006.01) |
| ***B65D 5/56*** | (2006.01) |
| ***B65D 5/72*** | (2006.01) |
| ***B65D 83/08*** | (2006.01) |
| *B31B 120/40* | (2017.01) |
| *B31B 100/00* | (2017.01) |

(52) U.S. Cl.

CPC ..... *A47K 10/32* (2013.01); *B65D 5/563* (2013.01); *B65D 5/727* (2013.01); *B65D 83/0805* (2013.01); *B65D 83/0894* (2013.01); *A47K 2010/3266* (2013.01); *B31B 2100/0024* (2017.08); *B31B 2120/40* (2017.08)

(58) Field of Classification Search

CPC ..... A47K 10/32

USPC ..... 221/33–63

See application file for complete search history.

(56) References Cited

U.S. PATENT DOCUMENTS

| | | | | |
|---|---|---|---|---|
| 4,436,221 | A | 3/1984 | Margulies | |
| 6,412,656 | B1 | 7/2002 | Placik | |
| 7,219,815 | B2 * | 5/2007 | Shannon | G07F 11/045 221/33 |
| 7,410,052 | B2 * | 8/2008 | Cook | A47K 10/3827 242/598.5 |

(Continued)

FOREIGN PATENT DOCUMENTS

| | | |
|---|---|---|
| WO | 2007075861 | 7/2007 |

OTHER PUBLICATIONS

Int'l Search Report and Written Opinion Appln No. PCT/US2021/047158 dated Dec. 7, 2021.

*Primary Examiner* — Gene O Crawford
*Assistant Examiner* — Ayodeji T Ojofeitimi
(74) *Attorney, Agent, or Firm* — McAndrews, Held & Malloy, Ltd.

(57) ABSTRACT

An example material sheet dispenser includes: a wall portion configured to form a volume; a first end portion comprising one or more sections attached to a first end of the wall portion and configured to cover a first end of the volume; and a second end portion comprising: a dispensing section attached to a second end of the wall portion and configured to cover a second end of the volume opposite the first end of the volume, and the dispensing section having a dispensing aperture configured to permit dispensing of sheets of a wiping material; and a cover section attached to the wall portion and configured to cover the dispensing aperture.

15 Claims, 7 Drawing Sheets

(56) References Cited

U.S. PATENT DOCUMENTS

| | | | | |
|---|---|---|---|---|
| 8,668,159 | B2 | 3/2014 | Tondkar | |
| 10,246,214 | B1 | 4/2019 | Zhou | |
| 2002/0125264 | A1* | 9/2002 | Shiffler | B65D 83/0805 221/47 |
| 2003/0042169 | A1* | 3/2003 | Caporali | B07C 3/008 206/557 |
| 2003/0164317 | A1 | 9/2003 | Fujiwara | |
| 2003/0230504 | A1 | 12/2003 | Hamming | |
| 2004/0217121 | A1* | 11/2004 | Geyer | A47F 9/042 221/33 |
| 2005/0279756 | A1* | 12/2005 | Bitowft | A47K 10/426 221/45 |
| 2007/0257095 | A1 | 11/2007 | Molinare | |
| 2008/0110918 | A1 | 5/2008 | Lee | |
| 2014/0021215 | A1* | 1/2014 | Tran | A47K 10/42 221/45 |
| 2014/0239052 | A1 | 8/2014 | Bugas | |
| 2016/0031632 | A1* | 2/2016 | Ripberger | B65D 83/0835 221/48 |

* cited by examiner

CORRUGATED PACKAGES FOR PRE-SATURATED WIPES

RELATED APPLICATIONS

The present application claims the benefit of U.S. Provisional Patent Application Ser. No. 63/069,974, filed Aug. 25, 2020, entitled "CORRUGATED PACKAGES FOR PRE-SATURATED WIPES." The entirety of U.S. Provisional Patent Application Ser. No. 63/069,974 is expressly incorporated herein by reference.

BACKGROUND

This disclosure relates generally to packaging and, more particularly, to corrugated packages for pre-saturated wipes.

At times, market demand (both industrial and consumer demand) for pre-saturated wipes from perforated rolls and dispensers exceeds global supply. One challenge involved in meeting increased demand for pre-saturated wipes is the packaging in which the pre-saturated wipes are delivered to the user. Conventional pre-saturated wipe packaging is constructed from molded plastic, which can make increasing supply of the pre-saturated wipe packaging prohibitively expensive.

SUMMARY

Corrugated packages for pre-saturated wipes are disclosed, substantially as illustrated by and described in connection with at least one of the figures, as set forth more completely in the claims.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

The figures are not necessarily to scale. Wherever appropriate, similar or identical reference numerals are used to refer to similar or identical components.

DETAILED DESCRIPTION

Figure 1:
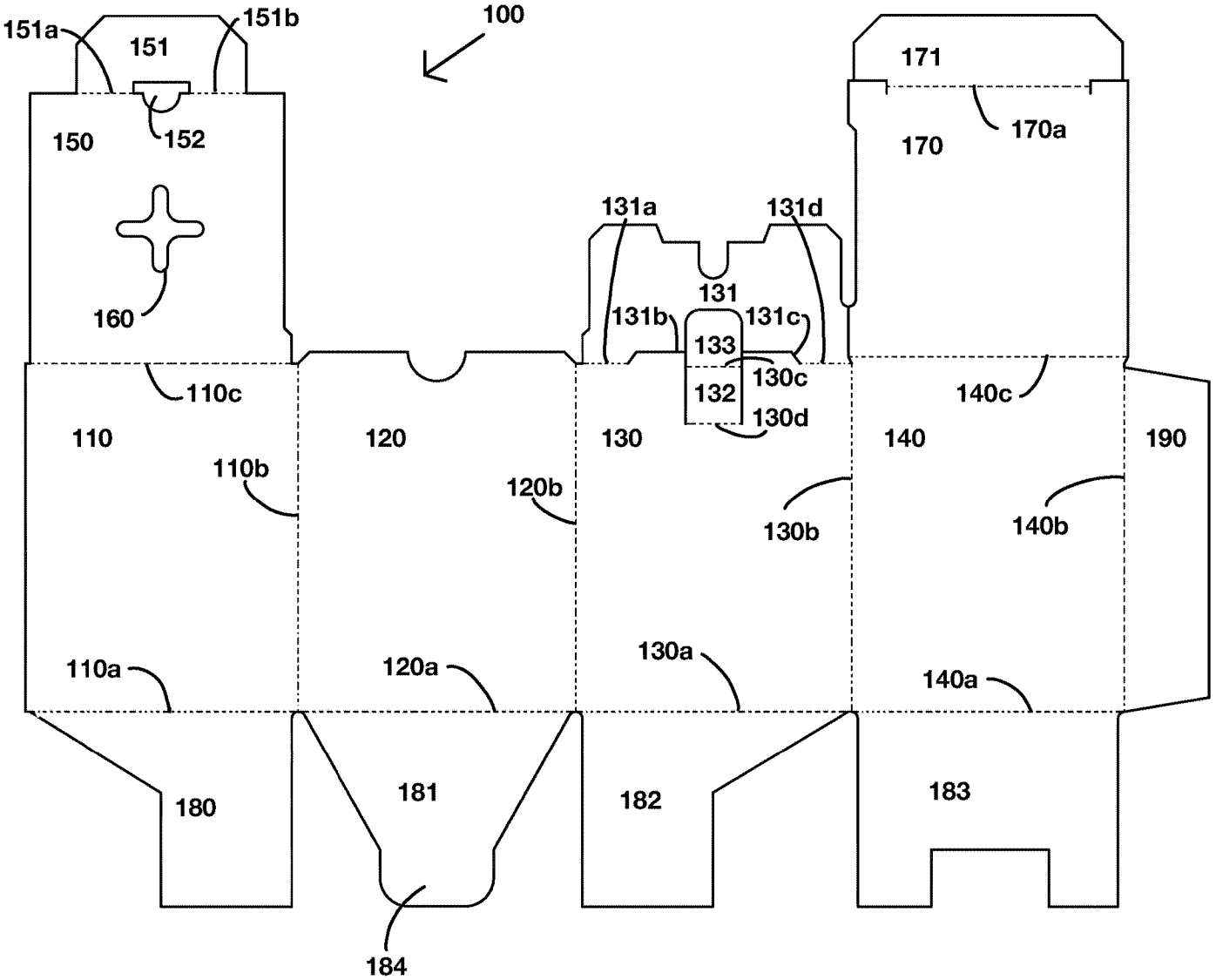
FIG. 1 is a view of an example deconstructed package for pre-saturated wipes, in accordance with aspects of this disclosure.

Pre-saturated wipes from interleaved stacks or perforated rolls typically require packages or dispensers for dispensing individual wipes from the roll. Conventional packages require expensive molds and injection molding equipment.

Disclosed example packages for pre-saturated wipes are constructed using a corrugated material, such as corrugated cardboard or corrugated plastic, and include an integrated cover section flap. Example packages disclosed herein may be stamped out of sheets of corrugated material, and then folded. Thus, disclosed example packages do not require expensive molds and injection molding equipment.

Disclosed example wiping material sheet dispensers include a wall portion configured to form a volume. The volume may include a first end portion comprising one or more sections attached to a first end of the law portion and configured to cover a first end of the volume and a second end portion including a dispensing section attached to a second end of the wall portion and configured to cover a second end of the volume opposite the first end of the volume. The dispensing section may have a dispensing aperture configured to permit dispensing of sheets of a wiping material, and a cover section attached to the wall portion and configured to cover the dispensing aperture. In some examples, the wall portion includes the dispensing section, including the dispensing aperture, instead of the end sections.

The wall portion and ends may make up any geometry, including a prism or any other three dimensional closed figure. The end portions, or bases, may be any two shapes, including circles, ovals, squares, rectangles, triangles, stars, any polygon, any parallelogram, or any curved shape. They may be the same shape, different shapes, or congruent shapes. The end portions may also be parallel to one another. In some examples, the ends are not be parallel to one another.

In some disclosed wiping material sheet dispensers, the first end portion, and the second end portion comprise corrugated cardboard. In some examples, at least one face of the corrugated cardboard is coated with a moisture resistant coating. The corrugated cardboard also may be lined with a moisture resistant material. The lining material may include at least one of a laminate, a foil, or a film. The lining material or coating may also be chemically resistant. As an example, the corrugated cardboard may have a thickness of 0.25 inches or less.

In some disclosed wiping material sheet dispensers, the wall portion, the first end portion, and second end portion comprise corrugated plastic. In some examples the plastic may also be coated or lined with a moisture resistant material. The lining material may include at least one of a laminate, a foil, or a film. The lining material, treatment, or coating may also be chemically resistant. In an example, the wall portion, the first end portion, and the second end portion may comprise a single, continuous sheet of material. In some disclosed wiping material sheet dispenser examples, the single continuous sheet of material may be folded to form the wall portion, the first end portion, and the second end portion. The wall portion, the first end portion, and the second end portion may be assembled from the single continuous sheet without adhesive or tape.

In some examples, the wall portion may comprise three or more sides, or a single continuous wall (e.g., a cylindrical shape). The dispensing section may be attached to a first one of the three or more sides, and the cover section may be attached to a second one of three or more sides.

Disclosed examples of the wiping material sheet dispenser include a dispensing plate configured to at least partially obstruct the dispensing aperture. The dispensing aperture may be configured to dispense perforated or interleaved sheets of wiping material from within the volume when uncovered, and the cover section may be configured to selectively cover or uncover the dispensing aperture.

Some disclosed wiping material sheet dispensers, at least one portion of the wall portion, the first end portion, or the second end portion may be configured to dissipate static electricity.

In an example, at least one of the wall portion, the first end portion, and the second end portion may be assembled using at least one of an adhesive or tape.

Disclosed examples of the wiping material sheet dispenser include pre-saturated wipes contained within the volume and dispensed through the dispensing aperture. The wipes also may not be pre-saturated.

The wiping material sheet dispenser may be any size, based on the size, quantity, and/or organization of the wipes in a package. The wipes may be perforated or interleaved within the package. In some examples, the wiping material sheet dispenser measures 5 inches×5 inches by 8 inches. In some examples, the wiping material sheet dispenser measures 6 inches by 6 inches by 9 inches. In some examples, the wiping material sheet dispenser measures 12 inches by 12 inches by 12 inches. However, any other dimensions or combinations of the above height, width, and length dimensions may be used. The wiping material sheet dispenser dispenses material sheets of any size. In some examples, the wiping material sheet dispenser dispenses sheets measuring 5 inches by 7 inches. In some examples, the wiping material sheet dispenser dispenses sheets measuring 6 inches by 9 inches. In some examples, the wiping material sheet dispenser dispenses sheets measuring 11 inches by 17 inches. However, any other dimensions or combinations of the above width and length dimensions may be used.

FIG. 1 is a view of an example deconstructed package for pre-saturated wipes 100, in accordance with aspects of this disclosure. The example package 100 is constructed from a single, continuous piece of corrugated material (e.g., cardboard), such as by stamping the package 100.

The example package 100 includes four side wall sections 110, 120, 130, 140. The four side walls 110, 120, 130, 140 form a perimeter around four sides of an example volume created the side walls 110, 120, 130, 140 are folded along dotted lines and secured. In the example of FIG. 1, the side wall 140 is attached to a tab 190, flap, or other attachment point for attachment to the wall section 110.

The first end of the volume (e.g., the bottom of the dispenser 100) may be covered by a series of sections 180, 181, 182, 183. After folding the side walls 110, 120, 130, 140 along the dotted lines 110*b*, 120*b*, 130*b*, 140*b*, the sections 180-183 may be folded together to secure the bottom of the dispenser 100 without the use of tape or glue, and tab 190 may be folded and tucked behind section 110. Tab 190 also may be glued or taped behind section 110. For example, the section 183 may be folded first toward the volume on dotted line 140*a*, followed by adjacent sections 180, 182 on dotted lines 110*a* or 130*a*, respectively (in either order), and finally by the section 181 opposite the section 183 on dotted line 120*a*. The section 181 has a tab 184 that may be folded into the aperture of the opposing section 183, which interlocks the sections 180-183 to create a bottom section for supporting the wipes within the volume.

To secure the top of the dispenser, sections 132 and 133 are cut along their solid sides and then folded inward along 130*c* and 130*d*. Solid lines 131*b* and 131*c* are cut so that once tab 151 is folded along 151*a* and 151*b*, it may slide into the space between sections 130 and 131. Finally, tab 133 is folded into aperture 152. Cover section 170 may cover the dispensing section 150 by folding along dotted line 140*c*. The cover section may be secured in place by folding along dotted line 170*a* and tucking tab 171 inside the package behind section 120.

The dispensing section 150 may have a dispensing aperture 160 and a cover section 170 that cover the second end (e.g., the top of the package 100). The dispensing section 150 may be attached to one of the four side wall sections 110. The cover section 170 may be attached to one of the four side wall sections 140.

Collectively, the side walls 110, 120, 130, 140, the dispensing section 150, the cover section 170, and the end sections 180-183 form a wall portion configured to form an interior volume; a first end portion, attached to a first end of the wall portion, that covers a first end of the volume; and a second end portion having a dispensing section that dispenses the wipes from the interior of the volume, and a cover section that covers the dispensing aperture.

The interior and/or exterior faces of the package 100 may be treated with materials to reduce or prevent breakdown in the material of the package 100 by the wipe-saturating cleaning solution. For example, the package 100 may be coated, lined, and/or impregnated with coatings or linings, such as FluteSHIELD® coating from Cascades Sonoco, SurfSHIELD™ coating from Cascades Sonoco, wax, a laminate, foil, films, and/or any other material. Example cleaning solutions that may be used to saturate or soak the wiping material, and from which the coating may protect the package 100, may include water, organic solvents, alcohol-based solvents such as isopropyl alcohol, and/or any other cleaning solutions. Additionally or alternatively, the package 100 may be constructed from a corrugated plastic or other materials that are resistant to the cleaning solutions. In some examples, the corrugated material and/or the coating, lining, and/or impregnation material dissipate static electricity.

The package 100 contains the roll of wipes for dispensation via the dispensing aperture 150. When the cover section 170 is opened, the wipes may be dispensed via the dispensing aperture 160. The cover section 170 may be replaced to cover the dispensing aperture 160, thereby reducing or preventing drying of the wipes or the evaporation of the cleaning solution.

Figure 2:
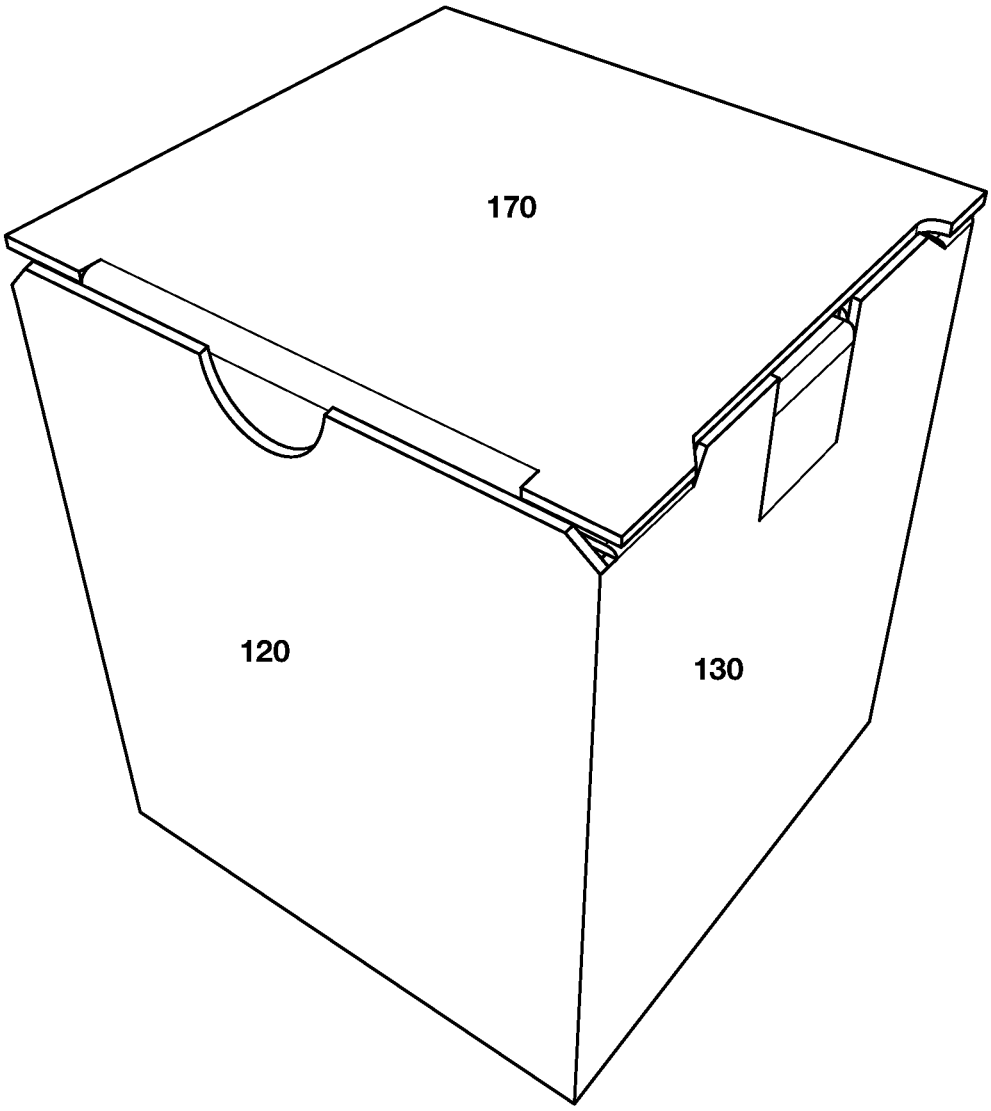
FIG. 2 is a perspective view of the example package of FIG. 1 as constructed, in which the cover section is closed.

FIG. 2 is a perspective view of the example package 100 of FIG. 1 as constructed, in which the cover section 170 is closed to cover the dispensing section (not pictured). Two side wall sections 120, 130 are pictured.

Figure 3:
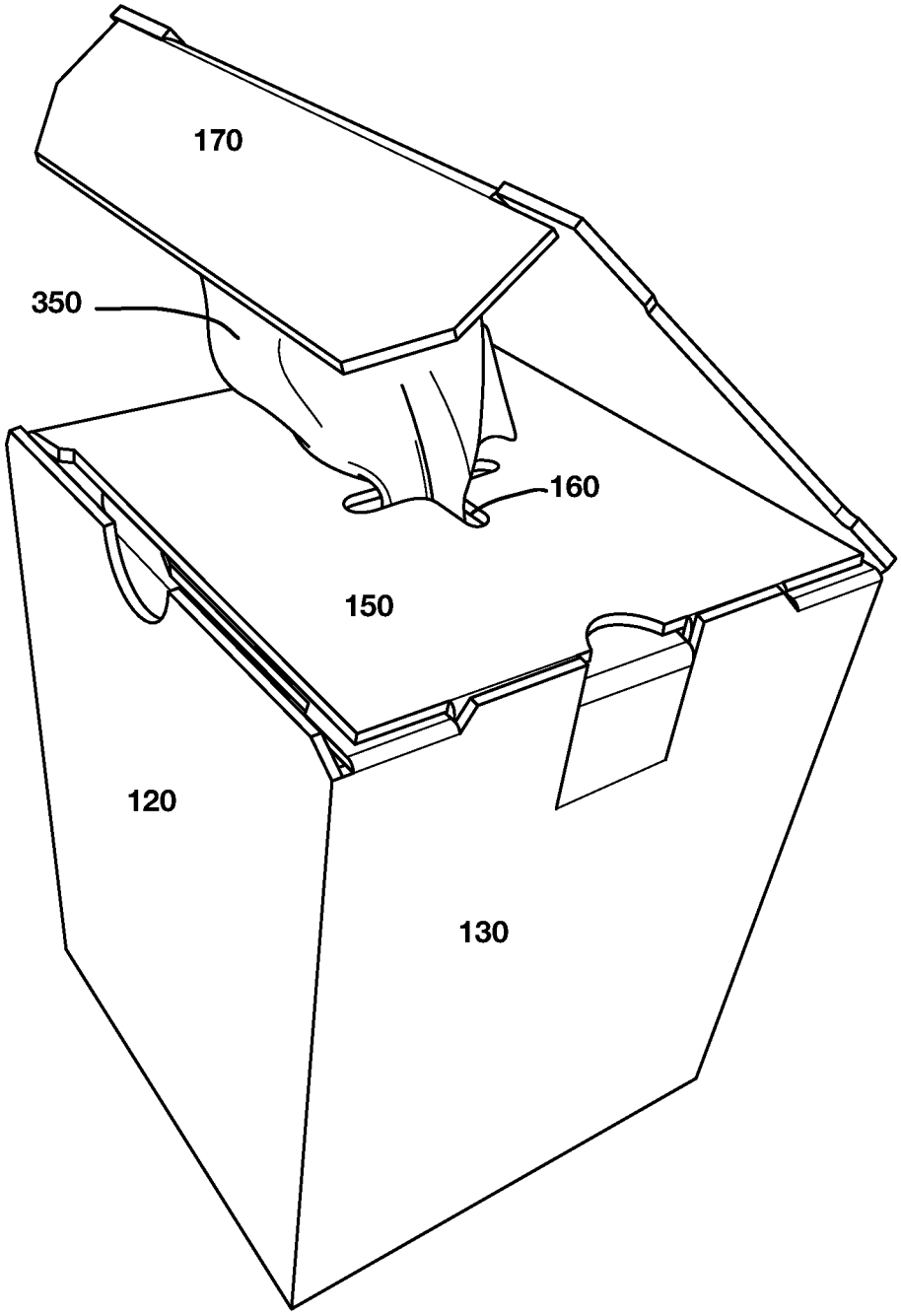
FIG. 3 is a perspective view of the example package of FIG. 1 as constructed, in which the cover section is opened to expose a dispensing aperture and the pre-saturated wipes from an interior of the package.

FIG. 3 is a perspective view of the example package 100 of FIG. 1 as constructed, in which the cover section 170 is opened to expose a dispensing aperture 160 and the pre-saturated wipes 350 from an interior of the package. When the cover section 170 is in an open position, the dispensing section 150 is exposed, and the dispensing aperture 160 may have a pre-saturated wipe 350 partially out of the dispensing aperture 160. In operation, a user may pull the exposed portion of the pre-saturated wipe 350 up and then laterally at a perforation point in order to remove the wipe from the wiping material sheet dispenser package 100. Two side wall sections 120, 130 are pictured.

Figure 4:
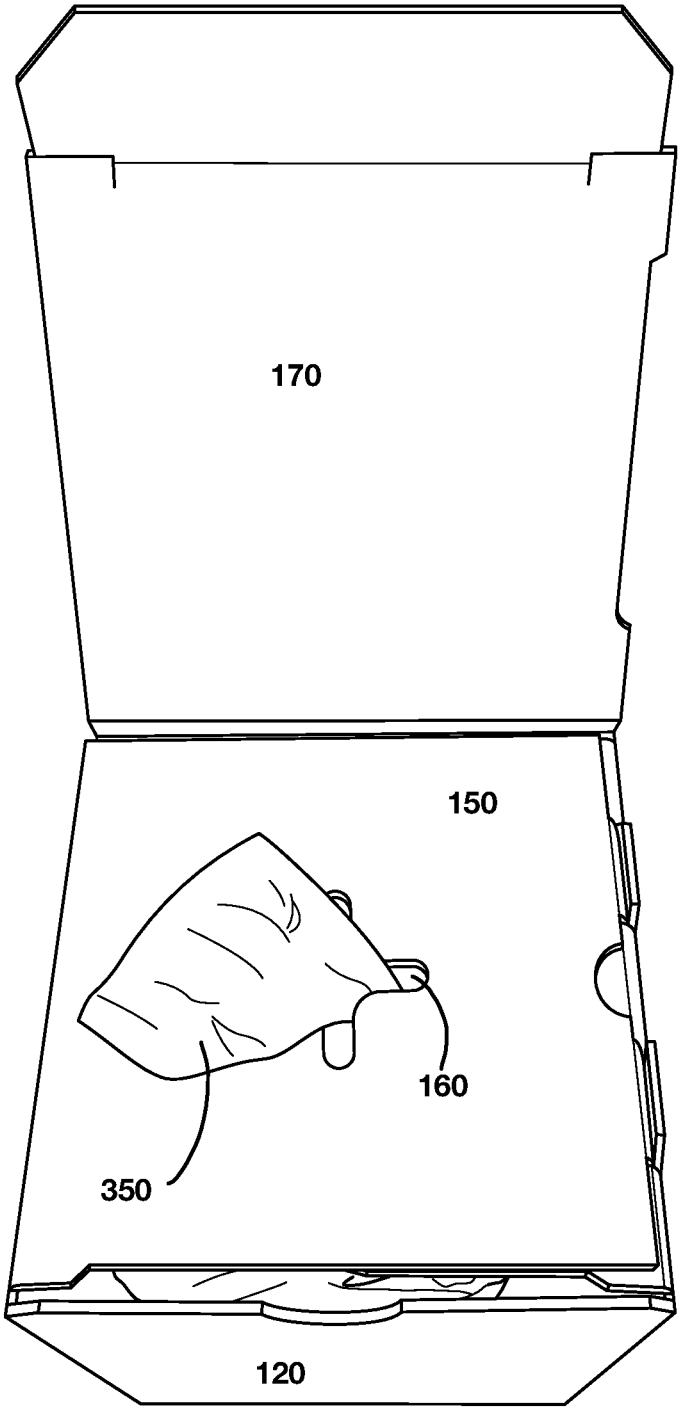
FIG. 4 is a top view of the example package of FIG. 1 as constructed, in which the cover section is opened to expose the dispensing aperture and the pre-saturated wipes from an interior of the package.

FIG. 4 is a top view of the example package 100 of FIG. 1 as constructed, in which the cover section 170 is opened to expose the dispensing aperture 160 and the pre-saturated wipes 350 from an interior of the package. When the cover section 170 is in an open position, the dispensing section 150 is exposed, and the dispensing aperture 160 may have a pre-saturated wipe 350 partially out of the dispensing aperture 160. A user may pull the exposed portion of the pre-saturated wipe 350 up and then laterally at a perforation point in order to remove the wipe from the wiping material sheet dispenser 100. One side wall section 120 is pictured.

Figure 5:
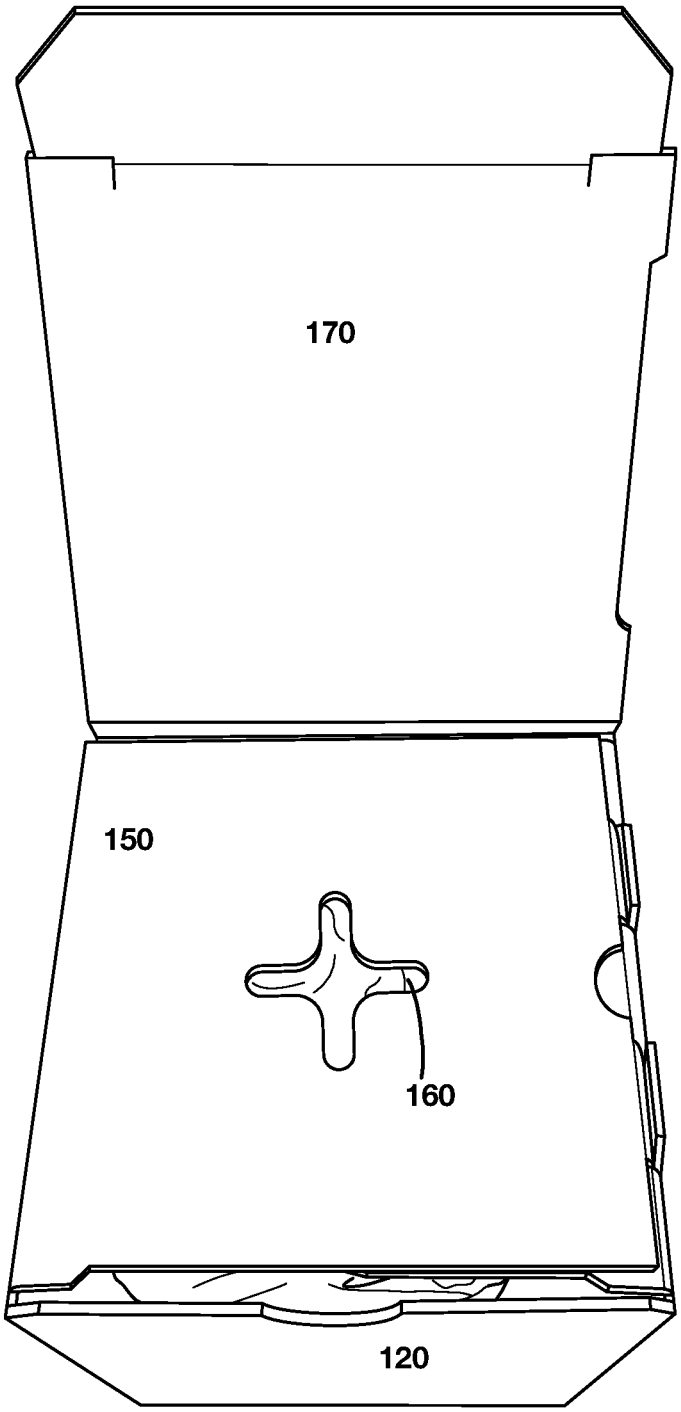
FIG. 5 is a top view of the example package of FIG. 1 as constructed, in which the cover section is opened to expose the dispensing aperture, and omitting the pre-saturated wipes.

FIG. 5 is a top view of the example package 100 of FIG. 1 as constructed, in which the cover section 170 is opened to expose the dispensing aperture 160, and omitting the pre-saturated wipes. When the cover section 170 is in an open position, the dispensing section 150 is exposed, and the dispensing aperture is exposed. The dispensing aperture may be any shape, including a cross, a rectangle, an oval, a circle, a triangle, an "X," or a star. One side wall section 120 is pictured.

Figure 6:
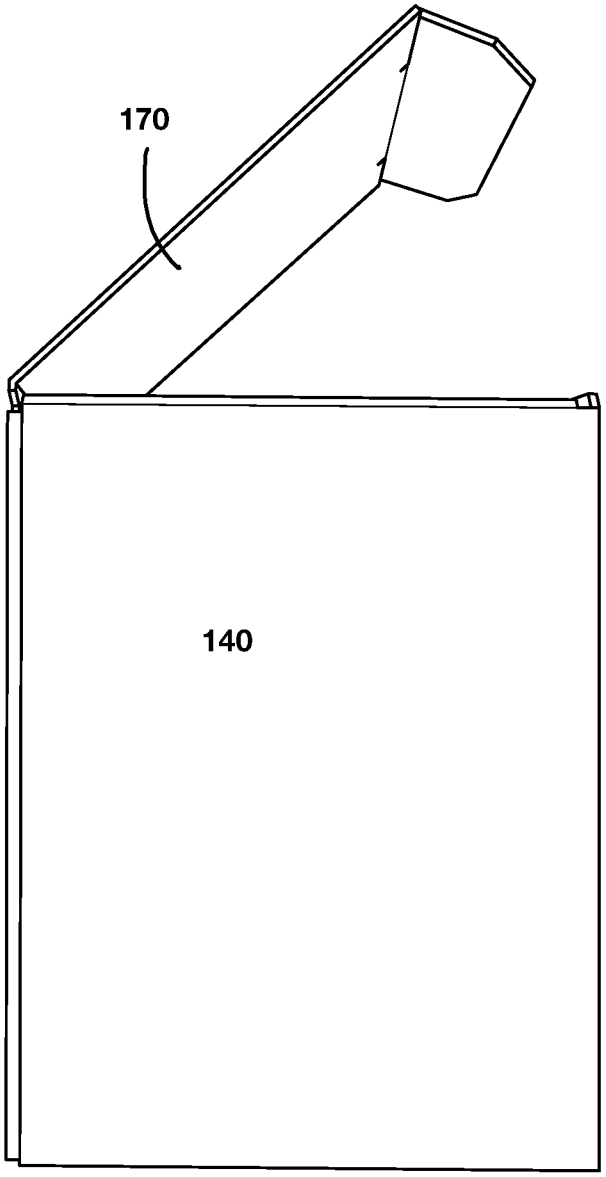
FIG. 6 is an elevation view of the example package of FIG. 1 as constructed, in which the cover section is opened to expose the dispensing aperture.

FIG. 6 is an elevation view of the example package 100 of FIG. 1 as constructed, in which the cover section 170 is opened to expose the dispensing aperture 160. One side wall 140 is pictured.

Figure 7:
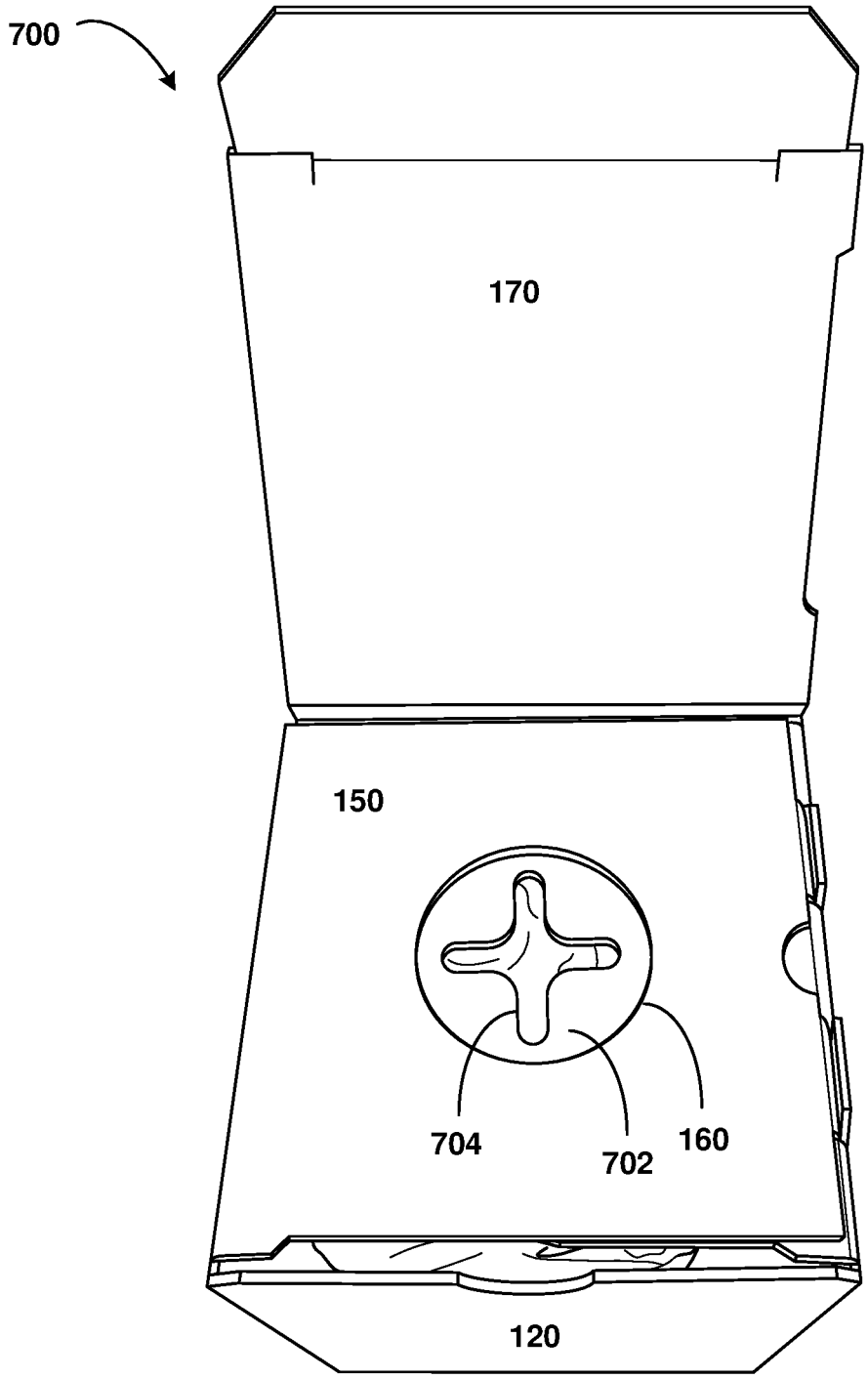
FIG. 7 is a top view of another example package, which is similar to the package of FIGS. 1-6, and further including a dispensing plate having a dispensing aperture, in accordance with aspects of this disclosure.

FIG. 7 is a top view of another example package 700, which is similar to the package 100 of FIGS. 1-6, except that the package 700 further includes a dispensing plate 702 that includes a dispensing aperture 704. In the example package 700, the dispensing plate 702 may be attached to an interior face of the dispensing portion 150. The dispensing aperture of FIG. 7 may be have a circular or other shape that is larger than the dispensing aperture 704.

While the present system has been described with reference to certain implementations, it will be understood by those skilled in the art that various changes may be made and equivalents may be substituted without departing from the scope of the present system. For example, block and/or components of disclosed examples may be combined, divided, re-arranged, and/or otherwise modified. In addition, many modifications may be made to adapt a particular situation or material to the teachings of the present disclosure without departing from its scope. Therefore, the present method and/or system are not limited to the particular implementations disclosed. Instead, the present method and/or system will include all implementations falling within the scope of the appended claims, both literally and under the doctrine of equivalents.

What is claimed is:

1. A wiping material sheet dispenser, comprising:

a wall portion configured to form a volume, the wall portion comprising three or more sides;

a first end portion comprising one or more sections attached to a first end of the wall portion and configured to cover a first end of the volume; and a second end portion comprising:

a dispensing section attached to a first side of the three or more sides of the wall portion at a second end of the wall portion and configured to cover a second end of the volume opposite the first end of the volume, and the dispensing section having a dispensing aperture configured to permit dispensing of sheets of a wiping material; and a cover section attached to a second side of the three or more sides of the wall portion at the second end of the wall portion and configured to cover the dispensing aperture.

2. The wiping material sheet dispenser as defined in claim 1, wherein at least one of the wall portion, the first end portion, or the second end portion are configured to dissipate static electricity.

3. The wiping material sheet dispenser as defined in claim 1, wherein at least one of the wall portion, the first end portion, and the second end portion is assembled using at least one of an adhesive or tape.

4. The wiping material sheet dispenser as defined in claim 1, further including pre-saturated wipes contained within the volume and dispensed through the dispensing aperture.

5. The wiping material sheet dispenser as defined in claim 1, wherein the dispensing aperture is configured to dispense at least one of perforated sheets or interleaved sheets of wiping material from within the volume when uncovered, and the cover section is configured to selectively cover or uncover the dispensing aperture.

6. The wiping material sheet dispenser as defined in claim 1, further comprising a dispensing plate configured to at least partially obstruct the dispensing aperture.

7. The wiping material sheet dispenser as defined in claim 1, wherein the wall portion, the first end portion, and the second end portion comprise corrugated plastic.

8. The wiping material sheet dispenser as defined in claim 1, wherein the wall portion, the first end portion, and the second end portion comprise corrugated cardboard.

9. The wiping material sheet dispenser as defined in claim 8, wherein at least one face of the corrugated cardboard is lined or coated with a material that is resistant to a cleaning solution absorbed into the wiping material.

10. The wiping material sheet dispenser as defined in claim 9, wherein the lining material comprises at least one of a wax, a laminate, a treatment material, a foil, or a film.

11. The wiping material sheet dispenser as defined in claim 8, wherein at least one face of the corrugated cardboard is impregnated with a material that is resistant to a cleaning solution absorbed into the wiping material.

12. The wiping material sheet dispenser as defined in claim 8 wherein the corrugated cardboard has a thickness of 0.25 inches or less.

13. The wiping material sheet dispenser as defined in claim 1, wherein the wall portion, the first end portion, and the second end portion comprise a single, continuous sheet of material.

14. The wiping material sheet dispenser as defined in claim 13, wherein the single, continuous sheet of material is folded to form the wall portion, the first end portion, and the second end portion.

15. The wiping material sheet dispenser as defined in claim 13, wherein the wall portion, the first end portion, and the second end portion are assembled from the single, continuous sheet without adhesive or tape.

* * * * *